US007948512B2

(12) United States Patent
Yoshida et al.

(10) Patent No.: US 7,948,512 B2
(45) Date of Patent: May 24, 2011

(54) IMAGE FORMING APPARATUS WITH SEPARATE CONTROLLERS FOR INDEPENDENTLY CONTROLLING AN IRRADIATING SECTION

(75) Inventors: Seiichi Yoshida, Nara (JP); Kazuyuki Ohnishi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/398,632

(22) Filed: Mar. 5, 2009

(65) Prior Publication Data

US 2009/0226196 A1 Sep. 10, 2009

(30) Foreign Application Priority Data

Mar. 5, 2008 (JP) ..... 2008-055147

(51) Int. Cl.
*B41J 2/435* (2006.01)
*B41J 2/47* (2006.01)

(52) U.S. Cl. ..... 347/237; 347/247

(58) Field of Classification Search ..... 347/236, 347/237, 240, 246–247, 251–254
See application file for complete search history.

(56) References Cited

U.S. PATENT DOCUMENTS 5,019,913 A 5/1991 Kiya et al.
5,351,107 A * 9/1994 Nakane et al. ..... 399/49
5,715,498 A * 2/1998 Takeuchi et al. ..... 399/40
2006/0274384 A1 12/2006 Hayashi et al.
2008/0259978 A1* 10/2008 Hamagishi et al. ..... 372/29.02

FOREIGN PATENT DOCUMENTS

| | | |
|---|---|---|
| EP | 541064 A2 * | 5/1993 |
| JP | 61-177255 | 8/1986 |
| JP | 63-317349 | 12/1988 |
| JP | 4-126448 | 4/1992 |
| JP | 11-174760 | 7/1999 |
| JP | 2000-112261 | 4/2000 |
| JP | 2001-238050 | 8/2001 |
| JP | 2002-211036 | 7/2002 |
| JP | 2002-365983 | 12/2002 |
| JP | 2005-132049 | 5/2005 |
| JP | 2006-267143 | 10/2006 |
| JP | 2006-332860 | 12/2006 |
| JP | 2006-334982 | 12/2006 |
| JP | 2007-079222 | 3/2007 |
| JP | 2008-003396 | 1/2008 |
| JP | 2008/040155 | 2/2008 |

* cited by examiner

*Primary Examiner* — Hai C Pham
(74) *Attorney, Agent, or Firm* — David G. Conlin; Steven M. Jensen; Edwards Angell Palmer & Dodge LLP

(57) ABSTRACT

A main controller controls drive of an LSU for irradiating laser light onto a charged photoreceptor, based on control data read from a non-volatile memory. The main controller causes the LSU to irradiate a beam of light onto the photoreceptor so as to form on the photoreceptor an electrostatic latent image corresponding to an image to be formed. A controlling section reads through an image reading section control data from the non-volatile memory at a different timing from a timing at which the main controller controls the LSU. The controlling section controls drive of the LSU based on the read control data.

8 Claims, 9 Drawing Sheets

IMAGE FORMING APPARATUS WITH SEPARATE CONTROLLERS FOR INDEPENDENTLY CONTROLLING AN IRRADIATING SECTION

CROSS-REFERENCE TO RELATED APPLICATION

This non-provisional application claims priority under 35 U.S.C. §119(a) on Patent Application No. 2008-55147 filed in Japan on Mar. 5, 2008, the entire contents of which are hereby incorporated by reference.

BACKGROUND

1. Technical Field

The present invention relates to an image forming apparatus for forming an image on a photoreceptor by irradiation of a beam of light.

2. Description of Related Art

A laser printer comprises a charged photoreceptor, and a laser scanning unit (hereinafter referred to as the LSU (Laser Scanning Unit) for irradiating laser light onto the photoreceptor according to image data. With the irradiation of laser light, electric charges in the irradiated portion of the photoreceptor are removed, and negatively charged toner is adhered to the removed portion. After transferring the toner adhering to the photoreceptor to paper, heat and pressure are applied to fix the toner, thereby performing printing corresponding to image data. In general, the LSU is controlled by a main controller which controls various devices in the laser printer. Image printing is performed by operating the LSU based on image data generated by the main controller, or read from a non-volatile memory, and control command data (see, for example, Japanese Patent Application Laid-Open No. 61-177255 (1986)).

SUMMARY

By the way, when the laser printer is activated, the main controller performs an initial process at the time of activation, such as, for example, the process of deleting the recorded contents in a memory and confirming connections to the respective devices in the laser printer. Thereafter, the main controller executes a process for bringing the respective devices including the LSU into an operation start state. In other words, the respective devices do not go into the operation start state unless the main controller finishes the initial process. Consequently, there is a problem that the standby time until the start of image formation after the activation of the laser printer is long. Since recent laser printers have increasingly advanced functions and perform complex processes along with the advancement of functions, the above-mentioned problem appears more noticeably.

The present invention has been made with the aim of solving the above problem, and it is an object of the invention to provide an image forming apparatus capable of shortening the standby time until the start of image formation.

An image forming apparatus according to the present invention is an image forming apparatus comprising: storage means for storing control data; irradiating means for irradiating a beam of light onto a charged photoreceptor; first controlling means for controlling drive of the irradiating means based on control data read from the storage means so as to form on said photoreceptor an electrostatic latent image corresponding to an image to be formed; reading means for reading control data from the storage means at a timing different from a timing at which the first controlling means controls the irradiating means; and second controlling means for controlling drive of the irradiating means based on the control data read by the reading means.

In this invention, the first controlling means controls drive of the irradiating means for irradiating a beam of light onto the photoreceptor, based on control data read from the storage means, so that an electrostatic latent image of an image to be formed is formed on the photoreceptor. Moreover, the second controlling means controls drive of the irradiating means based on control data read from the storage means at a different timing from control performed by the first controlling means.

The image forming apparatus according to the present invention is characterized in that the storage means stores control data for causing the second controlling means to execute an initial process so as to bring the irradiating means in a halt state into a standby state capable of irradiating a beam of light, the first controlling means performs a shift process for shifting the first controlling means from a halt state into a state capable of controlling the irradiating means, and the reading means reads the control data for executing the initial process from the storage means while the first controlling means is executing the shift process.

In this invention, the control data for executing the initial process for bringing the irradiating means into the state capable of irradiating a beam of light is stored in the storage means, and the second controlling means executes the initial process based on the control data stored in the storage means while the first controlling means is executing the shift process for shifting the first controlling means from the halt state into the state capable of controlling the irradiating means. Thus, since the shift process by the first controlling means and the initial process by the second controlling means can be executed in parallel, it is possible to shorten the standby time until the start of image formation.

The image forming apparatus according to the present invention is characterized in that the storage means stores control data for causing the second controlling means to control the irradiating means so as to form an electrostatic latent image of a test pattern on the photoreceptor by irradiating a beam of light, and the image forming apparatus further comprises adjusting means for adjusting a beam of light irradiated by the irradiating means, based on the electrostatic latent image of the test pattern.

In this invention, the control data for controlling the irradiating means to form an electrostatic latent image of a test pattern is stored in the storage means, and a beam of light is adjusted based on the formed electrostatic latent image of the test pattern. Thus, it is possible to adjust a beam of light independently of the first controlling means.

The image forming apparatus according to the present invention is characterized by further comprising: conveying means for conveying a recording medium; and forming means for forming an image on the recording medium by transferring the electrostatic latent image formed onto the photoreceptor to the recording medium conveyed by the conveying means, and wherein the reading means reads from the storage means the control data for controlling the irradiating means to form an electrostatic latent image of the test pattern before the recording medium is conveyed to the forming means by the conveying means.

In this invention, the second controlling means controls the irradiating means to form an electrostatic latent image of a test pattern before a recording medium is conveyed to the forming means. Therefore, when forming images on a plurality of recording media, it is possible to adjust a beam of light after the formation of an image on one recording medium but before the next recording medium is sent to the forming means.

The image forming apparatus according to the present invention is characterized in that the adjusting means adjusts an irradiation position on the photoreceptor onto which the irradiating means irradiates a beam of light.

In this invention, the irradiation position on the photoreceptor onto which the irradiating means irradiates a beam of light is adjusted based on the electrostatic latent image of the test pattern formed on the photoreceptor. Hence, it is possible to adjust the position of an image even when the first controlling means is executing other process.

The image forming apparatus according to the present invention is characterized in that the forming means adheres toner to an electrostatic latent image formed on the photoreceptor and transfers the image onto the recording medium, and the adjusting means adjusts a density of toner to be adhered to the electrostatic latent image by adjusting an intensity of a beam of light irradiated by the irradiating means.

In this invention, based on the electrostatic latent image of the test pattern formed on the photoreceptor, the density of toner to be adhered to the electrostatic latent image formed on the photoreceptor when transferring the image onto the recording medium is adjusted. Therefore, it is possible to adjust the toner density even when the first controlling means is performing other process.

The image forming apparatus according to the present invention is characterized in that the storage means is removable.

In this invention, since the storage means for storing control data is removable, it is possible to replace the storage means, and it is possible to control the irradiating means based on a plurality of pieces of control data.

The image forming apparatus according to the present invention is characterized in that the irradiating means is removable, and the storage means is installed in the irradiating means so that it is removable together with the irradiating means.

In this invention, since the storage means is installed in the removable irradiating means, it is possible to install the storage means at the same time the irradiating means is installed in the image forming apparatus. As a result, the installation of the storage means is easier.

In this invention, even when the first control means does not control or cannot control the irradiating means, it is possible to control the irradiating means by the second controlling means based on the control data stored in the storage means. In other words, the irradiating means can operate independently of the first controlling means. For example, even when the first controlling means is performing an initial operation, or performing image processing, after power is supplied, it is possible to operate the irradiating means. Thus, it is possible to shorten the processing time from the start to the end of image formation, and consequently it is possible to shorten the standby time of the user.

The above and further objects and features will more fully be apparent from the following detailed description with accompanying drawings.

DETAILED DESCRIPTION

The following description will explain in detail the present invention, based on the drawings illustrating an embodiment thereof.

Figure 1:
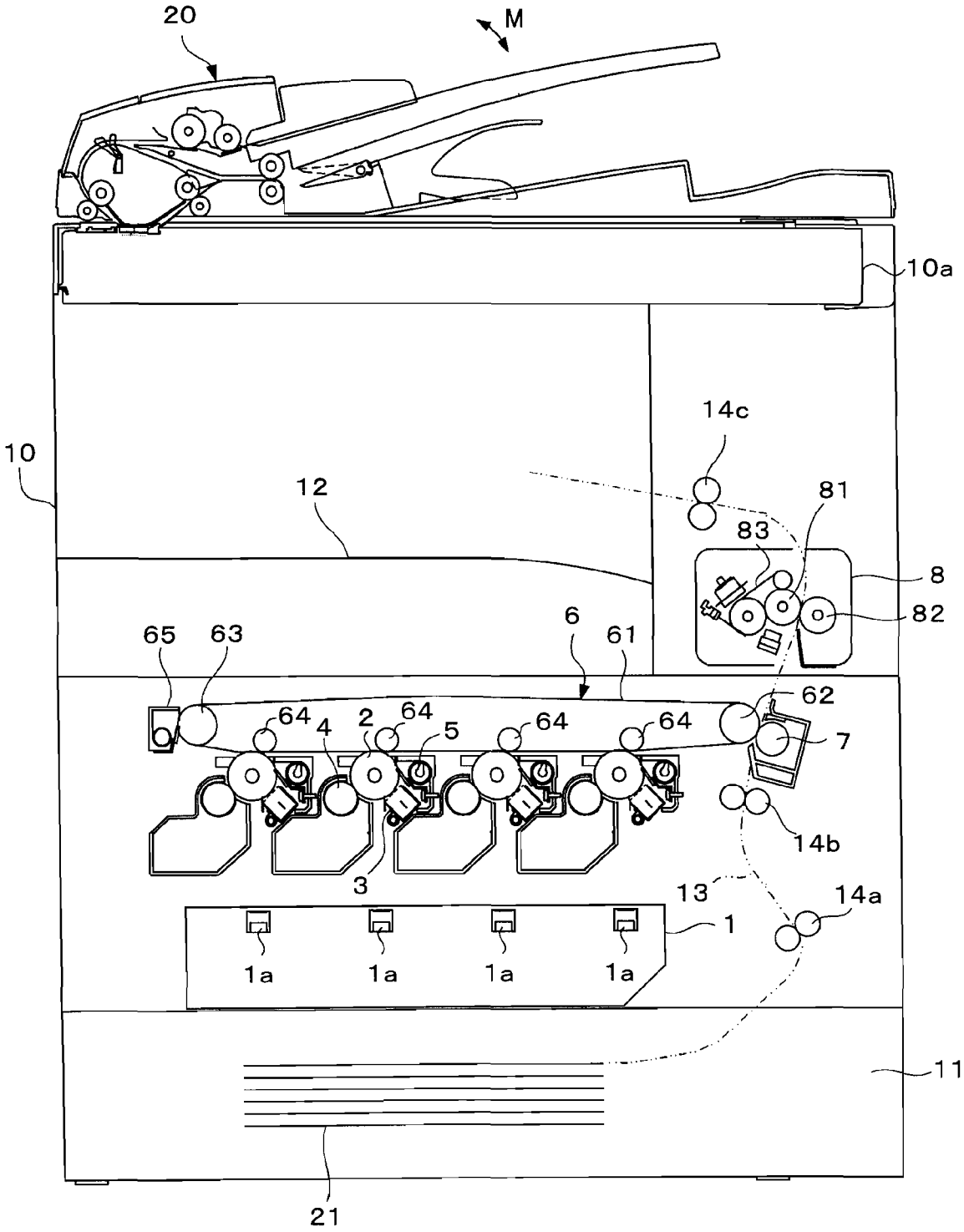
FIG. 1 is a view showing an image forming apparatus according to an embodiment.

FIG. 1 is a view showing an image forming apparatus according to an embodiment. FIG. 1 is a perspective side view partially showing the inside thereof.

The image forming apparatus according to this embodiment prints (forms) a multi-color or mono-color image on a predetermined sheet 21 (recording medium), according to image data transmitted from outside. The image forming apparatus comprises a housing 10 containing various devices, and an automatic document processor 20 provided above the housing 10.

Formed in the upper part of the housing 10 is a read board 10*a* for reading a document placed thereon. The automatic document processor 20 is provided above the read board 10*a*. The automatic document processor 20 automatically conveys a document to the read board 10*a*. The automatic document processor 20 is constructed to be capable of swinging in the directions shown by arrow M, and a document can be placed manually on the read board 10*a* by opening the upper side of the read board 10*a*.

An exposure unit 1 is placed in a lower part of the housing 10. The exposure unit 1 includes an irradiating section (irradiating means) 1*a* for irradiating laser light (a beam of light) vertically in an upward direction. A photoreceptor drum 2 is placed above the exposure unit 1, and the irradiating section 1*a* irradiates laser light onto the surface of the photoreceptor drum 2. The irradiating section 1*a* may be of a laser type using a semiconductor laser etc., or an LED type using an LED (Light Emitting Diode) array.

Provided near the photoreceptor drum 2 is an electrifier 3 for evenly charging the surface of the photoreceptor drum 2 to a predetermined electric potential. For the electrifier 3, it is possible to use a charger type electrifier, a contact type roller- or blush-like electrifier etc. By irradiating laser light from the irradiating section 1*a* onto the photoreceptor drum 2 having the charged surface, it is possible to form an electrostatic latent image on the surface of the photoreceptor drum 2. A developing unit (forming means, forming section) 4 adheres toner to the electrostatic latent image formed on the photoreceptor drum 2. A cleaner unit 5 removes and collects the toner remaining on the surface of the photoreceptor drum 2.

In this embodiment, four toner colors, yellow (Y), magenta (M), cyan (C) and black (K), are used, and four photoreceptor drums 2, four electrifiers 3, four developing units 4, and four cleaner units 5 are provided to correspond to the respective colors.

An intermediate transfer belt unit 6 (forming means, forming section) is placed above the photoreceptor drums 2. The intermediate transfer belt unit 6 comprises a belt 61, a driving roller 62, a driven roller 63, rollers 64, and a belt cleaning unit 65. Four rollers 64 are provided to correspond to the Y, M, C, and K colors, respectively.

The belt 61 is stretched over the driving roller 62, driven roller 63 and four rollers 64, and driven to rotate. The belt 61 is arranged to come into contact with the respective photoreceptor drums 2. By successively transferring toner images in the respective colors formed on the photoreceptor drum 2 in a superimposed manner to the belt 61, a color toner image (multi-color toner image) is formed on the belt 61. The belt 61 is formed in an endless form by using, for example, a film with a thickness of around 100 μm to 150 μm.

The transfer of the toner image from the photoreceptor drum 2 to the belt 61 is carried out by the roller 64 which is in contact with the back side of the belt 61. In order to transfer the toner image onto the belt 61, a high-voltage transfer bias (high voltage of opposite polarity (+) to the charged polarity (−) of toner) is applied to the roller 64. The roller 64 is a roller composed of a metal (for example, stainless) shaft with a diameter of 8 to 10 mm as a base whose surface is covered with a conductive resilient material (for example, EPDM or urethane foam). With this conductive resilient material, it is possible to evenly apply a high voltage to the belt 61. Although a roller form is used as a transfer electrode in this embodiment, it is also possible to use other form such as a brush.

The electrostatic latent images visualized according to the respective hues of Y, M, C and K on the respective photoreceptor drums 2 as described above are superimposed one upon the other on the belt 61. Thus, with a rotation of the belt 61, the electrostatic latent images superimposed one upon the other (multi-color toner image) are transferred onto paper by the transfer roller 7 located at the contact position between the paper and the belt 61.

The transfer roller (forming means, forming section) 7 is pressed against the belt 61 by a predetermined pressure, and a voltage for transferring the toner to the paper (high voltage of opposite polarity (+) to the charged polarity (−) of toner) is applied to the transfer roller 7. In order to constantly obtain the pressure, a hard material (such as a metal) is used for either the transfer roller 7 or the driving roller 62, and a soft material such as a resilient roller (a resilient rubber roller or a foamed resin roller etc.) is used for the other.

Toner that adheres to the belt 61 by contact with the photoreceptor drum 2, or toner that remains on the belt 61 without being transferred onto the paper by the transfer roller 7, may cause a mixture of toner colors in the following printing process, and is therefore removed and collected by the belt cleaning unit 65. The belt cleaning unit 65 comprises a cleaning blade as a cleaning member, for example, which comes into contact with the belt 61, and the belt 61 with which the cleaning blade comes into contact is supported by the intermediate transfer belt driven roller 63 from the back side.

Provided under the exposure unit 1 is a paper feed cassette 11 for storing sheets 21 to be used for image formation. Moreover, a paper output tray 12 for holding a stack of sheets 21 after printing is provided above the intermediate transfer belt unit 6. Formed in the housing 10 is a paper conveyance path 13 for feeding a sheet 21 from the paper feed cassette 11 to the paper output tray 12 via the transfer roller 7 and fixing unit 8. A plurality of small conveyance rollers (conveying means, conveying section) 14*a* to 14*c* for facilitating and assisting the conveyance of a sheet 21 are provided near the paper conveyance path 13.

The fixing unit 8 comprises a heat roller 81 and a pressure roller 82, and the heat roller 81 and the pressure roller 82 rotate while holding a sheet 21 between them. The heat roller 81 is set to be a predetermined fixing temperature based on a signal from a temperature detector, not shown, and has a function of fusing, combining and pressing multi-color toner images transferred onto a sheet 21 and thermally fixing the image onto the sheet 21 by fixing the toners to the sheet 21 with the application of heat and pressure together with the pressure roller 82. In addition, an external heat belt 83 for externally heating the heat roller 81 is provided.

Figure 2:
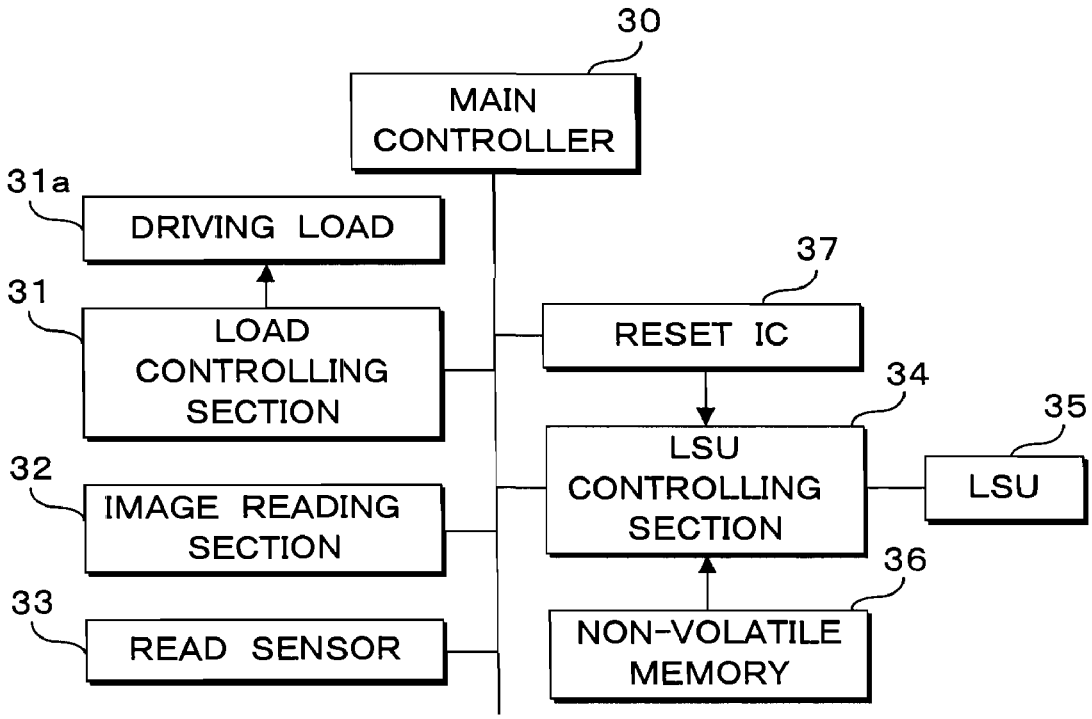
FIG. 2 is a block diagram schematically showing the structure of the image forming apparatus.

FIG. 2 is a block diagram schematically showing the structure of the image forming apparatus. The image forming apparatus comprises a main controller (first controlling means, first controlling section, adjusting means, adjusting section) 30, a load controlling section 31, an image reading section 32, a read sensor 33, an LSU controlling section 34, an LSU (irradiating means, irradiating section) 35, a non-volatile memory (storage means, storage section) 36, and a reset IC 37.

The main controller 30 is a micro computer including a CPU (Central Processing Unit) and a memory etc., and controls the entire image forming apparatus. The main controller 30 outputs a signal for controlling the load controlling section 31, and inputs data obtained by the load controlling section 31 from the load controlling section 31. The main controller 30 also generates image data about an image to be printed, and outputs a control signal for controlling drive of the LSU controlling section 34, or the LSU 35, such as a print instruction signal including data, to the LSU controlling section 34. The main controller 30 performs the process of converting RGB data into YMCK data when generating image data.

The load controlling section 31 controls the operations of the driving load 31*a*, such as the developing unit 4, the intermediate transfer belt unit 6, and the conveyance rollers 14*a* to 14*c* explained in FIG. 1. The image reading section 32 reads a document placed on the read board 10*a*. The read result is outputted to the main controller 30, and image data is generated in the main controller 30.

The read sensor 33 reads an electrostatic latent image that is an image adjustment test pattern formed on the charged surface of the photoreceptor drum 2. Examples of the image adjustment test pattern include a test pattern for adjusting the toner density, and a test pattern for adjusting the position in a scanning direction and focus position of laser light irradiated by the LSU 35. The results read by the read sensor 33 are outputted to the main controller 30, and the main controller 30 adjusts the toner density and the position of laser light based on the read results.

The read sensor 33 uses a highly sensitive optical sensor capable of accurately detecting the density difference of the test patterns, and is composed of a reflection type detection sensor including a light emitting section composed of LEDs etc., and a light receiving section composed of CCD (Charge Coupled Device) elements for receiving light from the light emitting section which is reflected by the photoreceptor drum 2, etc. For example, the main controller 30 calculates the toner density from the intensity of light received by the light receiving section, and sets so as to increase the light quantity of laser light when the toner density is low, or sets so as to decrease the light quantity of laser light when the toner density is high. Moreover, the main controller 30 adjusts the position in the scanning direction, or the focus position, of laser light of the LSU 35 based on positions of the test patterns read by the read sensor 33.

When a control signal such as a print instruction signal is received from the main controller 30, the LSU controlling section 34 reads control data from the non-volatile memory 36. When a print instruction signal is received, the LSU controlling section 34 controls lighting and the scanning direction of the laser diode of the LSU35 based on the image data included in the print instruction signal, irradiates laser light onto the photoreceptor drum 2, and forms an electrostatic latent image on the surface of the photoreceptor drum 2.

The LSU controlling section 34 controls drive of the LSU 35 based on control data. The LSU controlling section 34 reads control data stored in the non-volatile memory 36, at a timing at which it receives a control signal from the main controller 30, or a timing different from the timing of receiving the control signal. The details of the LSU controlling section 34 will be described later.

The LSU 35 is a component element corresponding to the above-described irradiating section la, and comprises a polygon motor, a polygon mirror, an Fθ lens, a laser diode, a mirror etc. The LSU 35 is controlled by the LSU controlling section 34, irradiates laser light onto the photoreceptor drum 2, and forms an electrostatic latent image on the surface of the photoreceptor drum 2. The formed electrostatic latent image is visualized with toner by the developing unit 4 etc. explained in FIG. 1, transferred onto a conveyed sheet 21 by the transfer roller 7, and then the visible image on the sheet 21 is fixed by the fixing unit 8.

The non-volatile memory 36 is a flash memory or an EPROM (Erasable Programmable ROM), and stores control data. The control data is read by the LSU controlling section 34 and used when the LSU controlling section 34 controls the LSU 35. The non-volatile memory 36 is removably installed in the image forming apparatus, and the non-volatile memory 36 is replaceable.

The reset IC 37 outputs a reset signal to the LSU controlling section 34 when power is supplied to the image forming apparatus. When the reset signal is outputted from the reset IC 37, the LSU controlling section 34 starts a later-described process.

Figure 3:
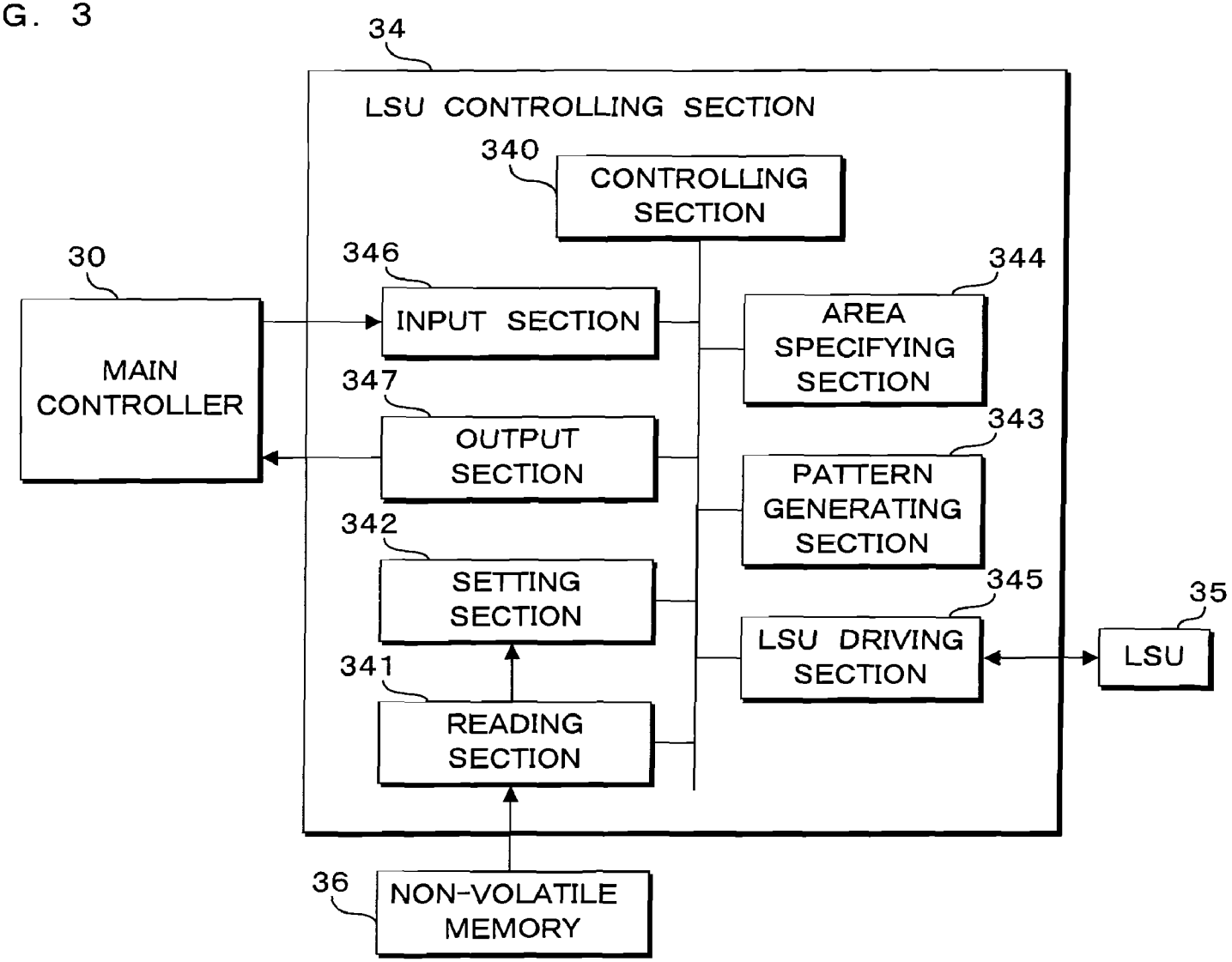
FIG. 3 is a block diagram schematically showing the functions of an LSU controlling section.

Next, the LSU controlling section 34 will be described in further detail. FIG. 3 is a block diagram schematically showing the function of the LSU controlling section 34. The LSU controlling section 34 comprises a controlling section (second controlling means, second controlling section) 340, a reading section (reading means, reading section) 341, a setting section 342, a pattern generating section 343, an area specifying section 344, an LSU driving section 345, and an input section 346 and an output section 347 for inputting and outputting data to or from the main controller 30.

The controlling section 340 starts to operate upon the input of a reset signal from the reset IC 37. The controlling section 340 controls drive of the LSU controlling section 34, based on a control signal from the main controller 30. For example, if the control signal is a print instruction signal, the controlling section 340 controls drive of the LSU 35 through the LSU driving section 345 so as to form an electrostatic latent image corresponding to image data included in the print instruction signal on the photoreceptor drum 2.

The reading section 341 detects whether or not the non-volatile memory 36 is connected, and accesses the non-volatile memory 36. When the LSU controlling section 34 is activated, that is, when a reset signal from the reset IC 37 is received, and after completion of printing on the sheet 21, the reading section 341 reads control data from the non-volatile memory 36. The control data read by the reading section 341 is written into the setting section 342. For example, in the case where images are printed on a plurality of sheets successively, "after the completion of printing on the sheet 21" includes the period from the completion of printing on one sheet 21 until the conveyance of the next sheet 21 to the transfer roller 7.

Addresses are assigned successively from 0 in the non-volatile memory 36, and the reading section 341 reads data sequentially from the address 0 of the non-volatile memory 36, after the activation of the LSU controlling section 34. After the completion of printing on the sheet 21, the reading section 341 reads data from the non-volatile memory 36 according to an address specified by a control signal outputted from the main controller 30.

The reading section 341 also reads control data from the non-volatile memory 36 when printing is started, that is, when a print instruction signal is received from the main controller 30. The print instruction signal includes an address, and the reading section 341 reads control data from the non-volatile memory 36 according to the address included in the print instruction signal.

The setting section 342 is a register group of the LSU controlling section 34 into which the control data read by the reading section 341 is written. The pattern generating section 343 generates arbitrary test pattern data for adjusting the toner density and for adjusting the focus point of laser light, according to settings in the setting section 342. The LSU 35 forms an electrostatic latent image as an image adjustment test pattern on the surface of the photoreceptor drum 2, based on the test pattern data.

The area specifying section 344 generates drawing control signals, such as a vertical synchronization signal and a horizontal synchronization signal, for creating an output area for an image to be formed on a sheet 21. These signals are outputted to the pattern generating section 343, LSU driving section 345, and main controller 30. For example, drawing control signals are outputted from the area specifying section 344 to the pattern generating section 343, lighting of the LSU 35 is controlled based on the drawing control signals, and an electrostatic latent image as a predetermined image adjustment test pattern is formed on the photoreceptor drum 2.

The LSU driving section 345 controls the LSU 35 according to the controlling section 340. For example, the LSU driving section 345 PWM-converts the image data included in the print instruction signal outputted from the main controller 30, and outputs the resulting data to the LSU 35. In addition, the LSU driving section 345 controls the LSU 35 based on the test pattern data outputted from the pattern generating section 343. For example, the LSU driving section 345 PWM-converts the test pattern data, and outputs the resulting data to the LSU 35. Accordingly, an electrostatic latent image is formed on the surface of the photoreceptor drum 2.

It may be possible that the LSU driving section 345 superimposes the image data included in the print instruction signal from the main controller 30 and the pattern data outputted from the pattern generating section 343, and controls the LSU 35 based on the result.

Further, the LSU driving section 345 performs a non-printing process for an image according to the contents of settings in the setting section 342. The non-printing process masks (hides) a part of the beginning and end portions of one line or one screen of image data so as to form a non-image area (void area).

Figure 4:
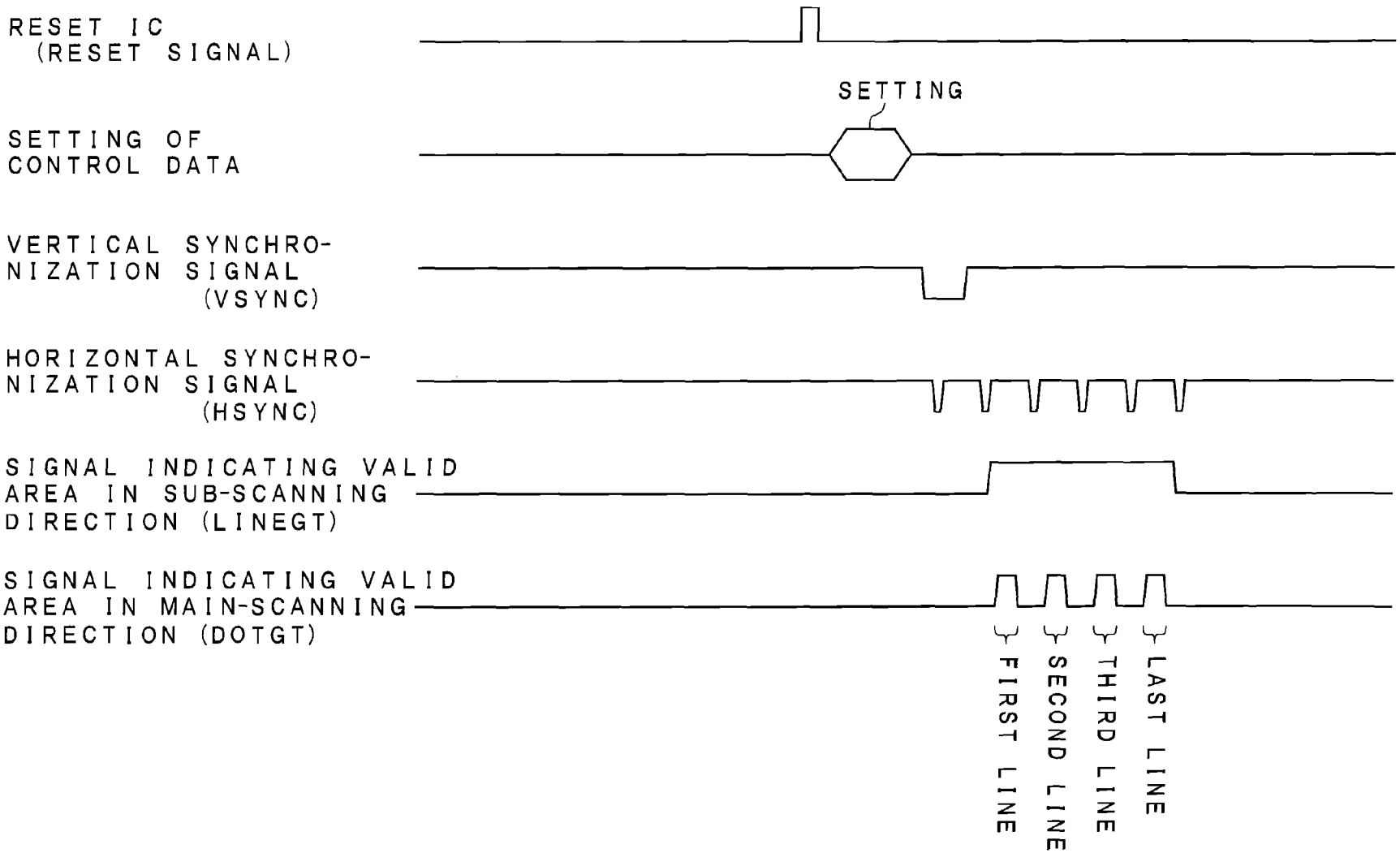
FIG. 4 is a view showing the output timing of drawing control signals when writing an electrostatic latent image of an image adjustment test pattern on a photoreceptor drum.

FIG. 4 is a view showing the output timing of drawing control signals when writing an electrostatic latent image of an image adjusting test pattern on the photoreceptor drum 2.

Figure 6:
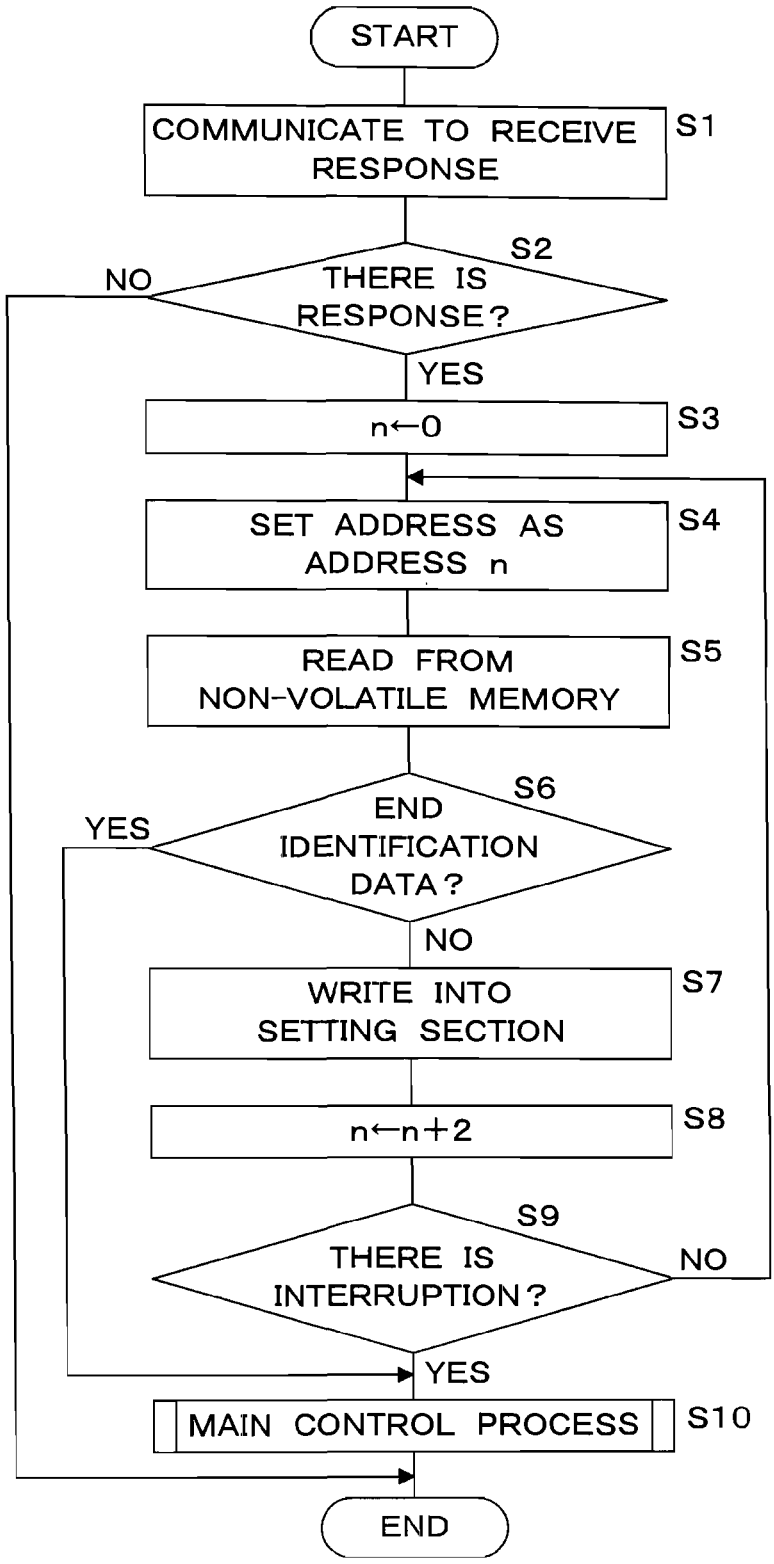
FIG. 6 is a flowchart showing an LSU operating process.

The LSU controlling section 34 is reset by the reset signal from the reset IC 37, and a later-described LSU operating process shown in FIG. 6 is started. The reading section 341 reads control data from the non-volatile memory 36, and writes the control data into the setting section 342. Thereafter, various drawing control signals generated in the area specifying section 344 are outputted to the pattern generating section 343. The drawing control signals include a vertical synchronization signal (VSYNC) showing the beginning of an output image in a conveyance direction of paper, a horizontal synchronization signal (HSYNC) indicating the beginning of each line in the output image, a signal (LINEGT) indicating a valid image area in a sub-scanning direction, and a signal (DOTGT) indicating a valid image area in a main-scanning direction. A part where both LINEGT and DOTGT are active is an output image area. With LINGEGT and DOTGT, it is possible to form a non-image area (void area) by masking (hiding) a part of the beginning and end portions of one line or one screen of image data. The LSU driving section 345 controls lighting of the LSU 35 based on the drawing control signals, and writes an electrostatic latent image as an image adjustment test pattern on the surface of the photoreceptor drum 2. The photoreceptor drum 2, electrifier 3, developing unit 4 etc. are separately controlled, and the written electrostatic latent image formed on the surface of the photoreceptor drum 2 is read by the read sensor 33 and recorded. After activating the main controller 30, a toner density adjustment and an image formation position adjustment are made based on the recorded output of the read sensor 33.

Figure 5:
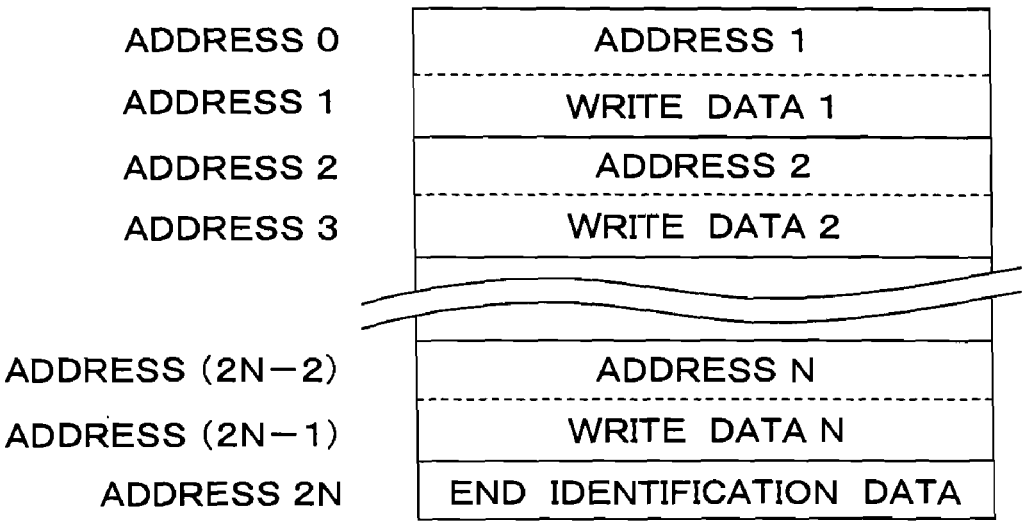
FIG. 5 is a schematic view for explaining a non-volatile memory which stores control data.

Next, the following will explain the non-volatile memory 36 for storing control data to be written into the setting section 342. FIG. 5 is a schematic view for explaining the non-volatile memory 36 for storing control data.

Addresses are assigned in the storage area of the setting section 342, and an address in the setting section 342 and data to be written in the address are stored as one set (a total of 2 bytes) in the non-volatile memory 36. For example, as shown in FIG. 5, address 1 of the setting section 342 is stored in the area of address "0" of the non-volatile memory 36, and the write data 1 to be written in the address 1 of the setting section 342 is stored in the area of address "1". More specifically, address N of the setting section 342 is stored in the area of the address "2N−2" of the non-volatile memory 36, and write data N to be written in the address N of the setting section 342 is stored in the area of address "2N−1 " of the non-volatile memory 36. In the last address of the non-volatile memory 36, identification data indicating the end of a data set is stored. The identification data is, for example, a non-existing address.

As the respective write data to be stored in the non-volatile memory 36, there are stored information about an electrostatic latent image to be formed, for example, information indicating the position of the electrostatic latent image to be formed on the photoreceptor drum 2, information about the timing of irradiating laser light, for example, the time at which the image formation position on a sheet 21 is determined, and the time from the start of rotation of the conveyance rollers 14*a* to 14*c* for conveying the sheet 21 to the transfer roller 7 to the non-image area.

Thus, by storing control data in the respective addresses of the non-volatile memory 36, the main controller 30 can set control data in the setting section 342 of the LSU controlling section 34 by only specifying an address of the non-volatile memory 36 for the LSU controlling section 34, thereby reducing the processing burden of the main controller 30.

For example, although settings in the setting section 342 vary according to the size of paper to be printed, the print resolution and gray level, the main controller 30 can complete the settings of the setting section 342 by just setting an address of a data set according to a print size. For example, it is possible to easily switch paper size between A4 and B5, switch the print resolution between 600 dpi and 1200 dpi, and switch the gray level among 256 gray level, 4 gray level, and 2 gray level.

Moreover, by storing in the non-volatile memory 36 control data for controlling the LSU 35 to execute the initial operation when power is supplied and specifying an address where the control data is to be stored by the controlling section 340 when power is supplied, the controlling section 340 can cause the LSU 35 to execute the initial operation independently of the main controller 30. Hence, the main controller 30 and the LSU controlling section 34 can perform processing in parallel, and it becomes possible to shorten the processing time.

In this embodiment, as described above, after the LSU controlling section 34 is activated, data is read sequentially from the address 0 of the non-volatile memory 36. Therefore, in the addresses 0 and 1 of the non-volatile memory 36, control data for bringing the LSU 35 into a standby state capable of irradiating laser light is stored. Hence, immediately after activating the LSU controlling section 34, the LSU controlling section 34 can switch the LSU 35 in the halt state to the standby state independently of the main controller 30.

Next, the following will explain the operation of the image forming apparatus constructed as described above.

FIG. 6 is a flowchart showing an LSU operating process. The controlling section 340 starts the LSU operating process shown in FIG. 6 when a reset signal is outputted from the reset IC 37.

First, the controlling section 340 performs communication to receive a response from the non-volatile memory 36 (S1). Then, the controlling section 340 determines whether or not there is a response from the non-volatile memory 36 (S2). If there is no response from the non-volatile memory 36 (S2: NO), the controlling section 340 determines that the non-volatile memory 36 is not connected, and finishes the processing.

If there is a response from the non-volatile memory 36 (S2: YES), the controlling section 340 determines that the non-volatile memory 36 is connected, and then sets "0" for n (S3), and sets an address to be read from the non-volatile memory 36 as the address n (S4). Next, the controlling section 340 reads data from the address n of the non-volatile memory 36 (S5). More specifically, as described above, an address of the setting section 342 and data to be written in the address are stored as one set (a total of 2 bytes) in the non-volatile memory 36. The controlling section 340 reads 2-byte data from the address n and the address n+1.

In short, the controlling section 340 reads data from the address 0 and address 1 of the non-volatile memory 36 at the start of this processing. As described above, in the addresses 0 and 1 of the non-volatile memory 36, the control data for bringing the LSU 35 into the standby state capable of irradiating laser light is stored. Accordingly, by starting this processing, the controlling section 340 enables drive of the LSU 35 without receiving a signal from the main controller 30.

Next, the controlling section 340 determines whether or not the data read from the non-volatile memory 36 is end identification data (S6). If it is end identification data (S6: YES), the controlling section 340 executes a later-described main control process of S10.

If it is not end identification data (S6: NO), the controlling section 340 writes the data read from the non-volatile memory 36 into the setting section 342 (S7). In the address n of the non-volatile memory 36, the address N of the setting section 342 is stored. Then, in the address N of the setting section 342, the controlling section 340 writes the control data stored in the address n+1 of the non-volatile memory 36.

Next, the controlling section 340 sets n to be "n+2" (S8). For example, if n is 1, then n becomes 3. The controlling section 340 determines whether or not there is an interruption from the main controller 30 (S9). If there is no interruption (S9: NO), the controlling section 340 moves the processing to S4, and repeats the above-mentioned operation. If there is an interruption (S9: YES), the controlling section 340 executes the main control process of S10. After completing the main control process, the controlling section 340 finishes this processing.

Figure 7:
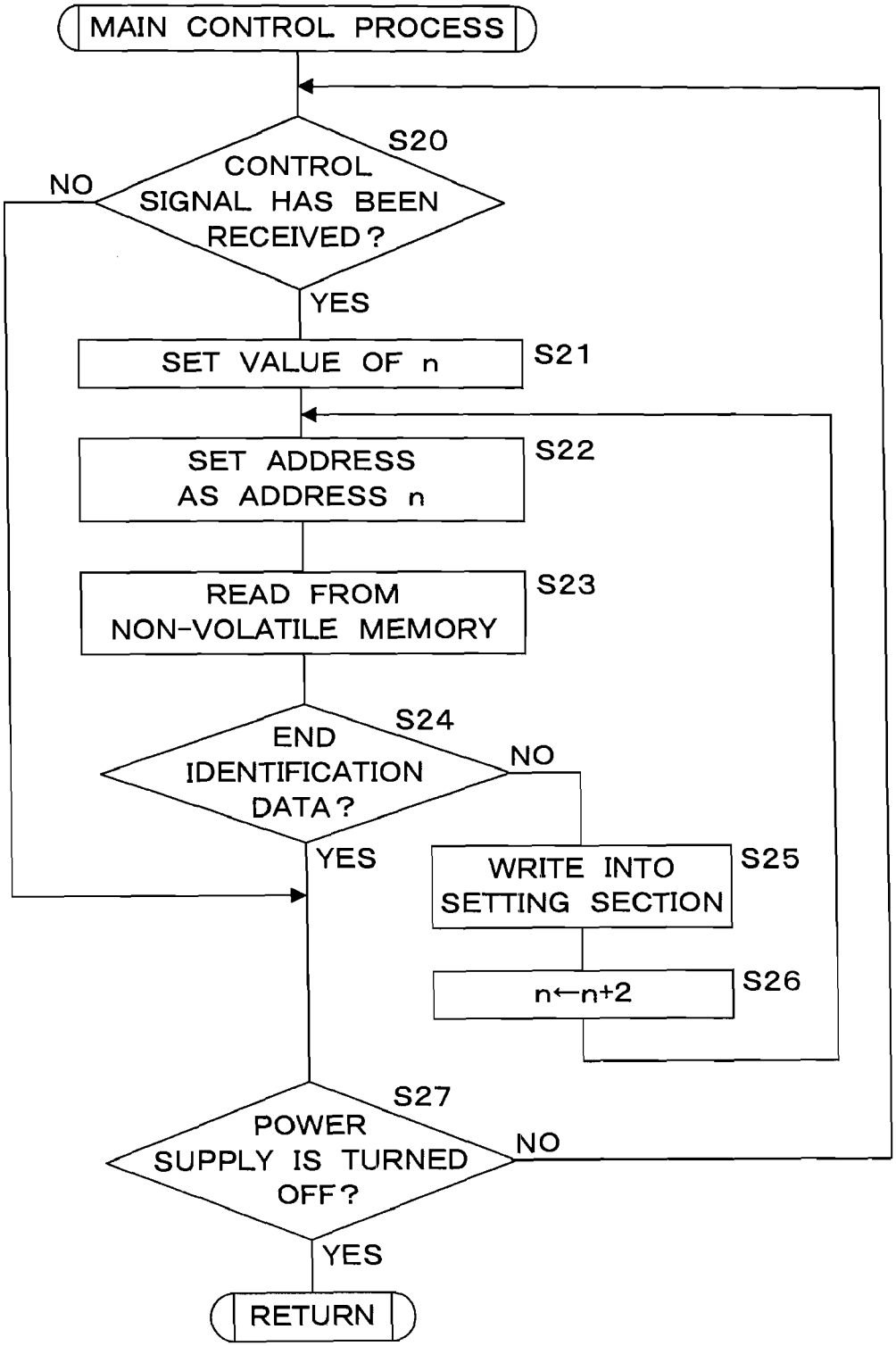
FIG. 7 is a flowchart showing the operation of a main control process.

FIG. 7 is a flowchart showing the operation of the main control process.

The controlling section 340 determines whether or not a control signal has been received from the main controller 30 (S20). If a control signal has not been received from the main controller 30 (S20: NO), the controlling section 340 moves the processing to S27. If a control signal has been received from the main controller 30 (S20: YES), the controlling section 340 sets the value of n based on the received control signal (S21), and sets an address to be read from the non-volatile memory 36 as the address n (S22).

Next, the controlling section 340 reads data from the address n of the non-volatile memory 36 (S23), and determines whether or not the data read from the non-volatile memory 36 is end identification data (S24). If it is end identification data (S24: YES), the controlling section 340 executes a later-described main control process of S27. If it is not end identification data (S24: NO), the controlling section 340 writes the data read from the non-volatile memory 36 into the setting section 342 (S25). More specifically, the controlling section 340 reads 2-byte data from the address n and address n+1. Then, the controlling section 340 writes the control data stored in the address n+1 of the non-volatile memory 36 into the "address N of the setting section 342" stored in the address n of the non-volatile memory 36.

Next, the controlling section 340 sets n to be "n+2" (S26). For example, if n is 1, then n becomes 3. The controlling section 340 moves the processing to S22, and repeats the above-mentioned operation. Thus, the controlling section 340 can control drive of the LSU 35 by only specifying an address of the non-volatile memory 36, without receiving control data from the main controller 30. For example, when printing images on a plurality of sheets 21 successively, the controlling section 340 can control drive of the LSU 35, based on a control signal outputted from the main controller 30, after printing one sheet 21 but before printing the next sheet 21. In this case, during the conveyance of the sheet 21, it is possible to adjust the LSU 35 while the main controller 30 is executing image processing.

It is possible to store a command (specifying output of a test pattern, for example) for the controlling section 340 in the non-volatile memory 36. In this case, by storing the command, it is possible to instruct output of a test pattern immediately after the completion of writing into the setting section 342, without receiving a control signal from the main controller 30.

Thereafter, the controlling section 340 determines whether or not the power supply is turn off (S27), and, if the power supply is turned off (S27: YES), the controlling section 340 finishes this processing and finishes the LSU control process of FIG. 6. If the power supply is not turned off (S27: NO), the controlling section 340 returns the processing to S20.

Figure 8:
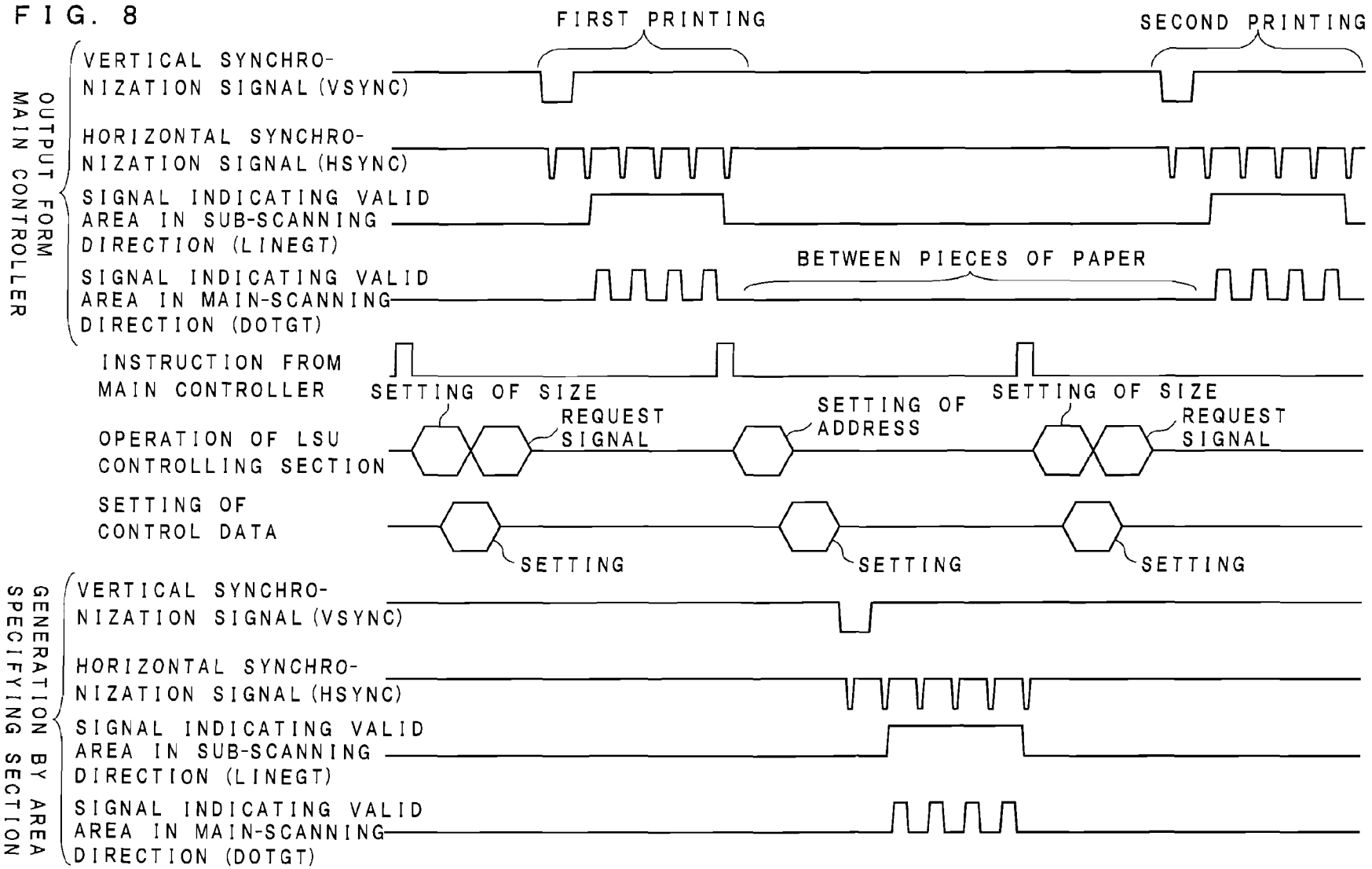
FIG. 8 is a view showing the output timing of drawing control signals between pieces of paper.

Next, the following will explain the timing of inputting/outputting data to/from the main controller 30 and the LSU controlling section 34. FIG. 8 is a view showing the output timing of drawing control signals between pieces of paper. In FIG. 8, the timing at which the main controller 30 outputs drawing control signals is shown above the operation timing of the LSU controlling section 34, while the timing at which the area specifying section 344 generates drawing control signals irrelevantly from the main controller 30 is shown below the operation timing.

Based on a command from the main controller 30, the LSU controlling section 34 reads data from the non-volatile memory 36, and writes into the setting section 342 various settings, such as the size of an image to be written on the photoreceptor drum 2, before first printing (the nth page image writing). After completing writing into the setting section 342, the LSU controlling section 34 sends an output request signal for requesting a transfer of the drawing control signals to the main controller 30. Accordingly, the LSU driving section 345 controls lighting of the LSU 35.

After finishing the first printing, the LSU controlling section 34 instructs the reading section 341 to set the beginning address for reading data from the non-volatile memory 36 and read data so that data is read from the non-volatile memory 36 and written into the setting section 342 based on an instruction from the main controller 30. The reading section 341 reads data from the non-volatile memory 36 and writes the data into the setting section 342, based on an instruction from the main controller 30. Based on the setting section 342, the area specifying section 344 generates drawing control signals between the first printing and the second printing that is printing of the next page (between pieces of paper). Accordingly, an electrostatic latent image as an image adjustment test pattern is formed on the surface of the photoreceptor drum 2.

Thereafter, the LSU controlling section 34 performs the second printing by executing the same operation as the operation explained for the first printing.

Since the image forming apparatus is constructed as described above, even when forming an electrostatic latent image as an image adjustment test pattern between pieces of paper, the main controller 30 only needs to send a command to the LSU controlling section 34 without the need of sending data about an image adjustment test pattern from the main controller 30 to the LSU controlling section 34, and hence the main controller 30 can execute other process during the paper intervals.

In this embodiment, as explained above, by storing control data for driving the LSU 35 in the non-volatile memory 36 and specifying an address in the non-volatile memory 36 by the controlling section 340, it is possible to read the control data from the non-volatile memory 36. In other words, the LSU controlling section 34 can control drive of the LSU 35 independently of the main controller 30. Hence, since the LSU 35 is controllable even when the main controller 30 is performing other process, it is possible to shorten the processing time from the start to the end of image formation, and consequently it is possible to shorten the user's waiting time.

In this embodiment, although the LSU 35 is controlled based on control data stored in the non-volatile memory 36, it is also possible to control the LSU 35 according to control data outputted from the main controller 30 to the LSU controlling section 34. Moreover, it is possible to suitably change the timing of reading control data from the non-volatile memory 36.

Figure 9:
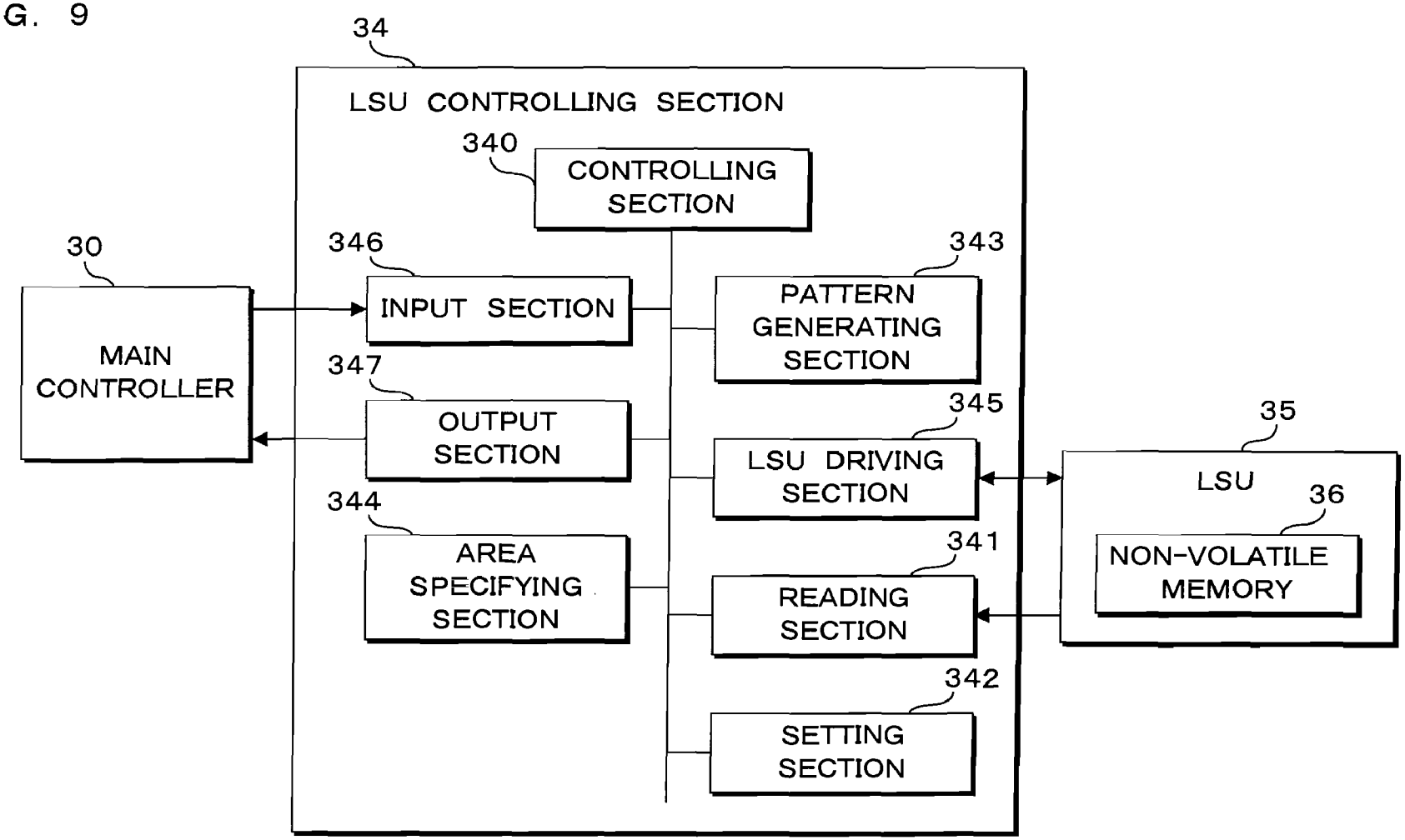
FIG. 9 is a block diagram schematically showing the functions of the LSU controlling section when the LSU and non-volatile memory are configured as a single unit.

Further, in this embodiment, although the LSU 35 and the non-volatile memory 36 are independent of each other, it may be possible to construct the LSU 35 and the non-volatile memory 36 as a single unit. FIG. 9 is a block diagram schematically showing the functions of the LSU controlling section when the LSU 35 and non-volatile memory 36 are configured as a single unit. As shown in FIG. 9, the non-volatile memory 36 is installed in the LSU 35, and the LSU 35 is made removable (replaceable) from the LSU controlling section 34. The non-volatile memory 36 and the reading section 341 are arranged to be connected at the same time the LSU 35 is connected to the LSU controlling section 34. Thus, when changing the specifications such as the scanning speed of laser light irradiated by the LSU 35, it is possible to connect a non-volatile memory 36 corresponding to the LSU 35 to the LSU controlling section 34 at the same time the LSU 35 is installed in the main body, thereby facilitating the replacement work of the non-volatile memory 36.

Although a preferred embodiment of the present invention is explained in detail above, it is possible to modify the structures and operations suitably without being limited to the above-described embodiment.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus comprising:

a storage section for storing control data;

an irradiating section for irradiating a beam of light onto a charged photoreceptor;

a reading section for reading control data from said storage section;

a first controlling section for controlling drive of said irradiating section based on the control data read from said storage section by said reading section so as to form on said photoreceptor an electrostatic latent image corresponding to an image to be formed; and a second controlling section for controlling drive of said irradiating section based on the control data read from said storage section by said reading section at a timing different from a timing at which said first controlling section controls said irradiating section, independently of the first controlling section while the first controlling section does not control the drive of the irradiating section.

2. The image forming apparatus according to claim 1, wherein said storage section stores control data for causing said second controlling section to execute an initial process so as to bring said irradiating section in a halt state into a standby state capable of irradiating a beam of light, said first controlling section performs a shift process for shifting the first controlling section from a halt state into a state capable of controlling said irradiating section, and said reading section reads the control data for executing the initial process from said storage section while said first controlling section is executing the shift process.

3. The image forming apparatus according to claim 1, wherein said storage section stores control data for causing said second controlling section to control said irradiating section so as to form an electrostatic latent image of a test pattern on said photoreceptor by irradiating a beam of light, and said image forming apparatus further comprises an adjusting section for adjusting a beam of light irradiated by said irradiating section, based on the electrostatic latent image of the test pattern.

4. The image forming apparatus according to claim 3, further comprising:

a conveying section for conveying a recording medium; and a forming section for forming an image on said recording medium by transferring an electrostatic latent image formed on the photoreceptor onto the recording medium conveyed by said conveying section, wherein said reading section reads the control data for controlling said irradiating section to form an electrostatic latent image of the test pattern from said storage section before the recording medium is conveyed to said forming section by said conveying section.

5. The image forming apparatus according to claim 4, wherein said forming section adheres toner to the electrostatic latent image formed on the photoreceptor and transfers the image onto the recording medium, and said adjusting section adjusts a density of toner to be adhered to the electrostatic latent image by adjusting an intensity of a beam of light irradiated by said irradiating section.

6. The image forming apparatus according to claim 3, wherein said adjusting section adjusts an irradiation position on the photoreceptor onto which said irradiating section irradiates a beam of light.

7. The image forming apparatus according to claim 1, wherein said storage section is removable.

8. The image forming apparatus according to claim 1, wherein said irradiating section is removable, and said storage section is installed in said irradiating section so that it is removable together with said irradiating section.

* * * * *